United States Patent [19]

Kurz et al.

[11] Patent Number: 4,478,444

[45] Date of Patent: Oct. 23, 1984

[54] DOOR BOLT IMMOBILIZING DEVICE

[75] Inventors: John L. Kurz, McConnellsburg; Harry F. Harshbarger, Robertsdale, both of Pa.

[73] Assignee: JGR Enterprises, Inc., Fort Littleton, Pa.

[21] Appl. No.: 445,553

[22] Filed: Nov. 30, 1982

[51] Int. Cl.[3] ..... E05C 9/06

[52] U.S. Cl. ..... 292/333

[58] Field of Search ..... 292/333, 335, 332, 334, 292/336

[56] References Cited

U.S. PATENT DOCUMENTS

| | | | |
|---|---|---|---|
| 228,323 | 6/1880 | Crandal | 292/333 |
| 361,247 | 4/1887 | Winchester | 292/333 |
| 521,458 | 6/1894 | Burns | 292/346 |
| 1,870,746 | 8/1932 | Pyle | 292/335 |

*Primary Examiner*—Richard E. Moore

*Attorney, Agent, or Firm*—Brady, O'Boyle & Gates

[57] ABSTRACT

To prevent costly damage to door frames and door bolting mechanisms caused by slamming of doors with security bolts projecting, a bolt immobilizing device automatic in its operation and biased toward the immobilizing position is installed on the door adjacent to the bolt. The device is moved to a bolt release position when the door is closed by engagement of an operator with the opposing stop surface of the door jamb. When the door is opened with the locking bolt retracted, the device returns automatically to the bolt immobilizing position. The device includes a shiftable blocking plate across the end face of the bolt in a plane perpendicular to the bolt axis.

13 Claims, 9 Drawing Figures

FIG.5
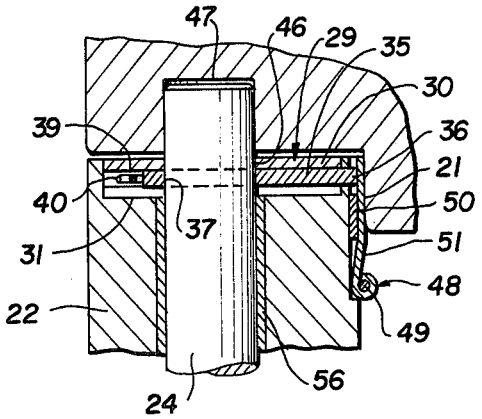
FIG.6
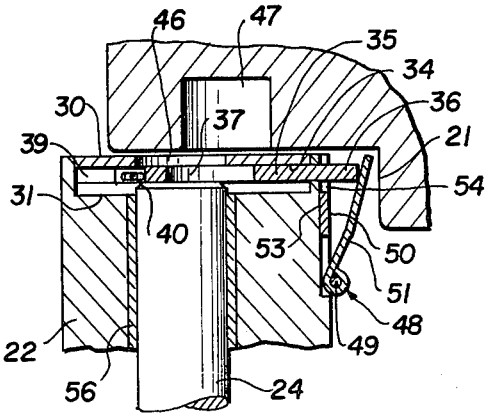
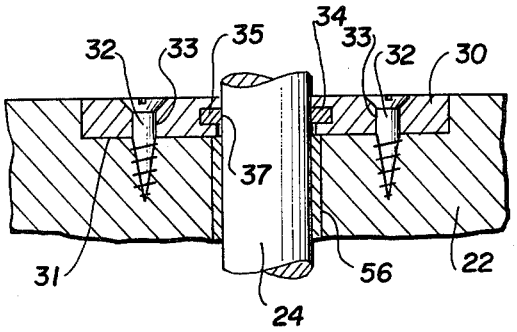
FIG.7
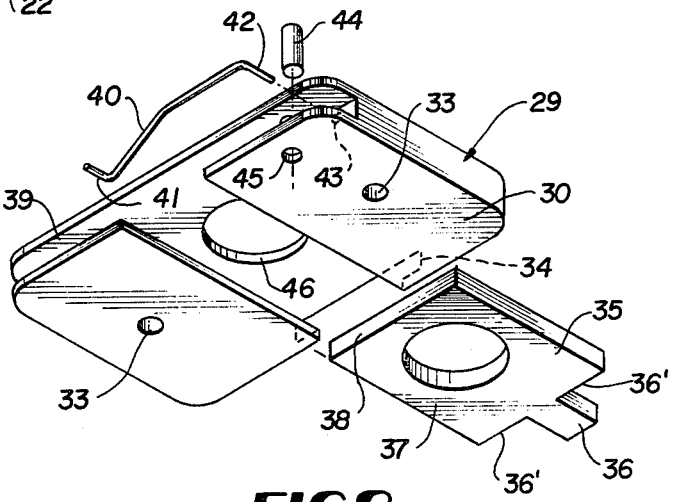
FIG.8
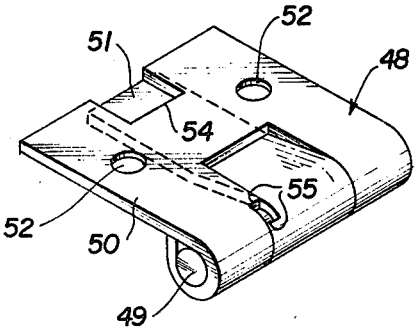
FIG.9

DOOR BOLT IMMOBILIZING DEVICE

BACKGROUND OF THE INVENTION

This invention relates to security bolting systems for doors and more particularly relates to a safety or immobilizing device which renders it impossible to extend the bolt to its locking position beyond the edge of the door while the door is open, for the purpose of preventing costly damage to the door frame or jamb, as well as to the bolt locking mechanism of the door. A necessity for the invention arises due to the tendency of children and others to play with door bolting mechanisms when the door is open, sometimes leaving the bolt or bolts in projected locking positions, whereby subsequent slamming of the door will cause very costly damage, in some instances.

An important objective of the invention, therefore, is to provide an immobilizing device for door bolts when the latter are in the retracted non-locking position while the door is open, thus rendering it impossible to shift the bolt to the locking position.

A further object is to provide a device of this character which is extremely simple, high compact, automatic and reliable in its operation, and which responds to the mere closing and opening of the door.

Other features and advantages of the invention will become apparent during the course of the following detailed description.

BRIEF DESCRIPTION OF THE DRAWINGS

FIG. 5 is a vertical section taken on line 5—5 of FIG. 3.

FIG. 6 is a similar section taken on line 6—6 of FIG. 4.

FIG. 7 is a fragmentary vertical section taken on line 7—7 of FIG. 3.

FIG. 8 is an exploded perspective view of the bolt immobilizing device or unit, parts omitted.

FIG. 9 is a perspective view of a hinge operator forming a part of the device.

DETAILED DESCRIPTION

Figure 1:
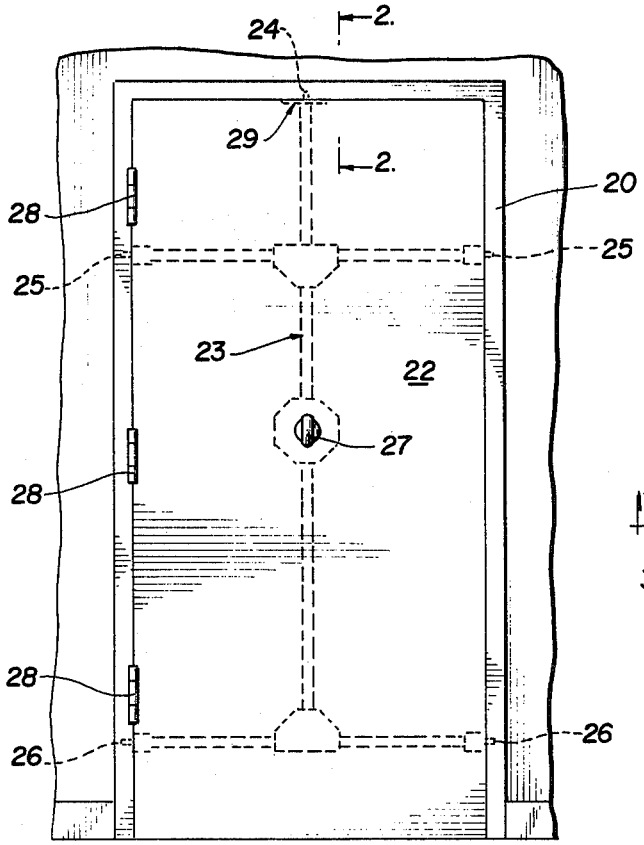
FIG. 1 is an interior side elevation of a door and security bolting system equipped with a bolt immobilizing device according to the present invention.
Figure 2:
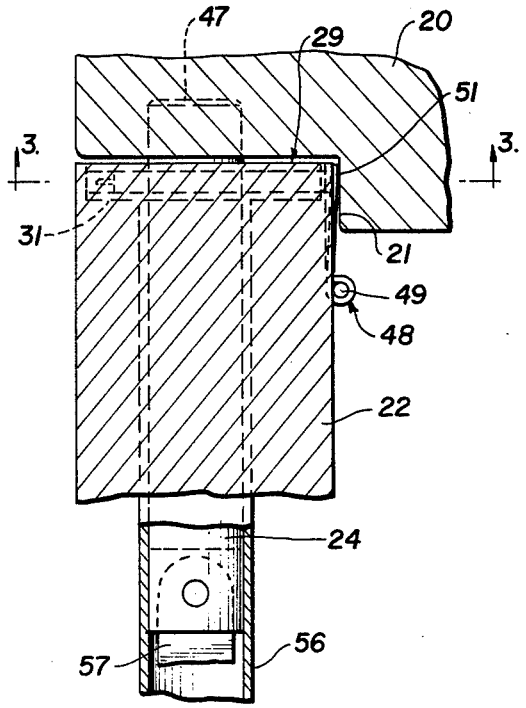
FIG. 2 is an enlarged fragmentary vertical section taken on line 2—2 of FIG. 1.

Referring to the drawings in detail wherein like numerals designate like parts, FIG. 1 depicts a door frame 20 including a jamb stop 21. A door 22 in its closed position within the frame 20 has a security bolting system shown in its active locking position and indicated by the numeral 23. This bolting or locking system includes a top bolt 24 and two upper and two lower side bolts 25 and 26, all such bolts being operated simultaneously by a linkage, not shown in detail, housed within the interior of the door 22 by a common interior rotatable operating handle 27. The door 22 is connected to the door frame along one vertical edge by hinges 28.

The bolt immobilizing device 29, according to the present invention, is installed on the door adjacent to the top vertical axis bolt 24. When this bolt is blocked or immobilized in its retracted position, the other four bolts 25 and 26 will also be immobilized in the system described in FIG. 1. However, the device 29 is not limited in its utility to the illustrated bolting system in FIG. 1 and may be used in other systems having a different arrangement of bolts, such as two vertical axis bolts or two transverse axis bolts only. Plural devices 29 can be utilized in bolting systems which may be split or divided and which have separate operating handles for each divided part of the system.

With reference to the illustrated embodiment of the invention, the single bolt immobilizing device 29 comprises a plate body portion 30 held within a shallow recess 31 formed in the top edge of the door 22 adjacent to the bolt 24. The plate body portion is anchored in the recess 31 by a pair of screws 32 received through openings 33 in the plate body portion.

The plate body portion 30 has a front-to-back internal shallow rectangular cross section guideway 34 or slot for the precision guidance of a bolt blocking plate 35 having a reduced width central contact extension 36 at one end thereof and having a bolt receiving aperture 37 of any required shape near its opposite end 38 which is preferably squared, as shown. End stop shoulders 36' for the blocking plate 35 are provided on opposite sides of the extension 36.

A transverse slot 39 formed through the end of the plate body portion away from the extension 36 intersects the guideway 34 at right angles thereto. Within this transverse slot 39 is placed a biasing spring 40 for the bolt blocking plate 35 having an elbow end 41 bearing on the end face 38. At its other end, the spring 40 carries an anchor extension 42 received in an anchor opening 43 of the plate body portion 30. A fixed spring retaining pin 44, which also resists flexure of the spring 40 under influence of the bolt locking plate 35, is held within a through opening 45 of the plate body portion across the transverse slot 39. The top wall portion of the plate body portion also has an aperture 46 of like size and shape with the aperture 37 and adapted to register therewith when the door is closed to permit movement of the bolt 24 to its projected locking position through the device 29 to a locking cavity 47 in the door jamb. The biasing spring 40 lies within the shallow slot 39 and intersecting guideway 34 which have the same depth.

Figure 3:
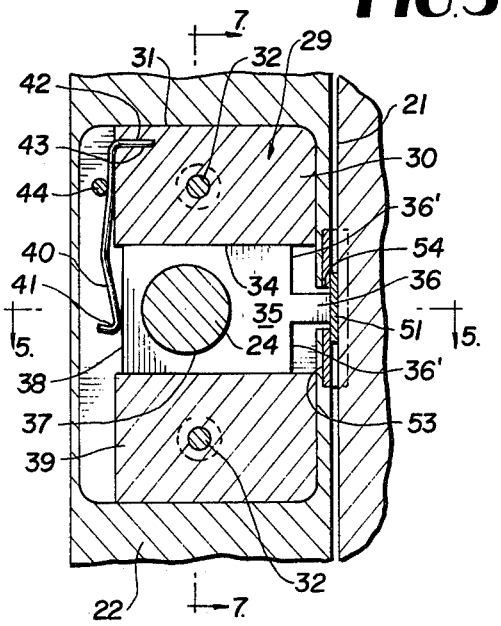
FIG. 3 is a horizontal section taken on line 3—3 of FIG. 2.

In addition to the already-described components, the bolt immobilizing device 29 includes an operator 48 in the nature of a hinge having a pintle 49 and leaves 50 and 51, the latter leaf forming the actuator for the blocking plate 35 against the force of biasing spring 40. The wider leaf 50 is provided with apertures 52 for mounting screws, not shown, whereby such leaf can be secured to the outer face of the door 22 adjacent to its top edge in a shallow recess 53. At its top edge, the leaf 50 has a notch 54 through which the extension 36 may operate. The comparatively narrow actuator leaf 51 extends between the end of extension 36 and the opposing face of jamb stop 21. When the door 22 is closed, actuator 51 engages the jamb stop and swings forwardly on the axis of pintle 49 to drive the bolt locking plate 35 forwardly in guideway 34 to the position shown in FIGS. 3 and 5 where the two apertures 37 and 46 are in registration allowing the bolt 24 to be shifted to its active locking position against the force of biasing spring 40.

Figure 4:
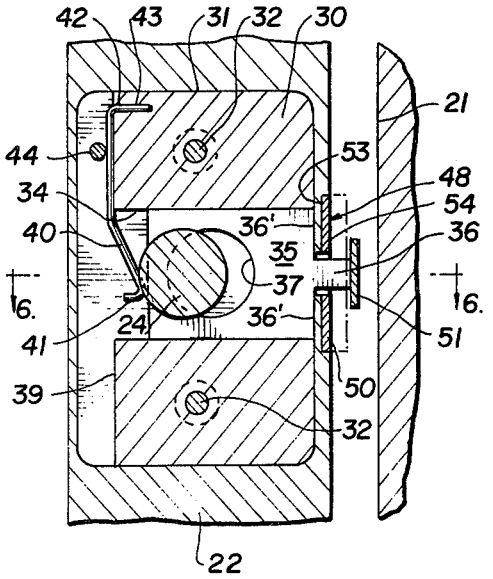
FIG. 4 is a view similar to FIG. 3 showing the device in the bolt immobilizing position as the door is being opened.

When the bolt 24 is retracted, together with the other bolts 25 and 26, by rotation of the common handle 27, the door 22 is released and may be opened. As opening takes place, FIGS. 4 and 6, and the door moves away from jamb stop 21, the spring 40 acts on the blocking plate 35 and shifts it to a position of nonregistration with the opening 46. Such shifting or movement places the foreward rounded end of the plate 35 across the end face of retracted bolt 24 to block or immobilize it so that the bolt cannot be moved by the handle 27 to its projecting or locking position while the door is open. This effectively prevents damaging the door frame and/or the bolt locking system should the door be slammed closed.

When the blocking plate 35 is moved by the spring 40 to the bolt immobilizing position, the actuator leaf 51 is likewise swung rearwardly as shown in FIG. 6. A built-in stop surface 55, FIG. 9, on the hinge operator limits rotation of the leaf 51 to approximately the position shown in FIG. 6, so that the leaf 51 will not swing down toward a depending vertical position on the outside of the door. The provision of the stop surface 55 eliminates the need for a spring on the knuckles of the hinge operator to control the actuator leaf 51.

The device is very compact, simple and reliable in operation. It is automatic, requiring no positive operation other than the opening and closing of the door. The advantage of the device in avoiding expensive damage to doors and door frames is readily apparent.

It might be mentioned that, in connection with the bolting system 23 shown schematically in FIG. 1, each bolt operates within a tough conduit 56, such as a section of electrical conduit, and each bolt is connected with and driven by a link 57 forming a part of a united linkage operated by the handle 27.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. An immobilizing device for a door bolt in the retracted position of the bolt comprising a body portion fixed to one edge portion of a door having a bolt operable on an axis across said edge portion at right angles thereto, said body portion having a guideway across the axis of the bolt at right angles thereto adjacent to the end face of the bolt when the bolt is in the retracted position, a bolt blocking plate movably engaged in said guideway and shiftable therein across the axis of the bolt between bolt blocking and bolt release positions, means engaged between the body portion and the blocking plate to yieldingly bias said blocking plate to the bolt blocking position, and an operator for the blocking plate on one face of the door comprising a first leaf fixed to one vertical face of the door at right angles to said door edge portion, a second movable actuator leaf for the blocking plate hingedly connected to the first leaf and engaging an end extension of the blocking plate away from the biasing means and being in opposed relationship to a door jamb stop surface, said first leaf having a passage through which the end extension of the blocking plate extends movably, whereby closing of the door carrying the bolt immobilizing device automatically shifts the bolt blocking plate to the bolt release position against the force of the biasing means.

2. An immobilizing device for a door bolt as defined in claim 1, and said means comprising a spring having a part thereof engaging the end of the blocking plate away from said end extension within said guideway.

3. An immobilizing device for a door bolt as defined in claim 2, and the body portion having a passage across the axis of the guideway and intersecting the guideway, and a part of the spring being disposed in said passage and being anchored to the body portion.

4. An immobilizing device for a door bolt as defined in claim 3, and said body portion comprising a comparatively shallow plate having the guideway and passage formed therein between the opposite faces of the plate, and the blocking plate comprising a comparatively thin flat plate slidably engaged in said guideway.

5. An immobilizing device for a door bolt as defined in claim 4, and the blocking plate having a bolt release opening formed therethrough between its ends adapted to register coaxially with the bolt and with a like opening in said plate when the blocking plate is in said bolt release position, thereby enabling movement of the bolt to a projecting door locking position outwardly of said edge portion.

6. An immobilizing device for a door bolt as defined in claim 1, and the bolt blocking plate having a bolt receiving opening formed therethrough between its ends adapted to register coaxially with the bolt and with a cooperative opening in the body portion across the axis of the guideway and in intersecting relationship with the guideway when the blocking plate is in the bolt release position.

7. An immobilizing device for a door bolt as defined in claim 1, and the body portion having a passage formed therein across the axis of said guideway in intersecting relationship therewith, and said means comprises a cantilever spring within said passage and having one end anchored to the body portion and having an opposite end projecting into the guideway and contacting the adjacent end of the bolt blocking plate.

8. An immobilizing device for a door bolt as defined in claim 7, and the adjacent end of the bolt blocking plate being positioned for camming engagement with the cantilever spring.

9. An immobilizing device for a door bolt in its retracted position adjacent to one edge of a door, said device comprising a plate body portion attached to said one edge of a door in substantially flush relationship therewith, the plate body portion having a guideway across the end face of the bolt substantially at right angles to the axis of the bolt in the retracted position of the bolt, the axis of the guideway being across said one edge of the door, a bolt blocking plate movably mounted in the guideway and being shiftable therein relative to the bolt end face between bolt blocking and bolt release positions, means on the plate body portion engaging the bolt blocking plate and biasing it toward the bolt blocking position, an extension on the end of the bolt blocking plate away from said means and a pair of stop shoulders on opposite sides of the extension limiting movement of the bolt blocking plate in one direction and establishing the bolt blocking position of the bolt blocking plate, and an opposing operator for the bolt blocking plate on one face of the door including a moving part in engagement with said extension of the blocking plate and disposed between the extension of the blocking plate and a door jamb face, whereby closing of the door and engagement of the moving part with the door jamb face will shift the bolt blocking plate to the bolt release position.

10. An immobilizing device for a door bolt as defined in claim 9, and the moving part of said operator including a stop restricting travel of the moving part in one direction.

11. An immobilizing device for a door bolt in the retracted position of the bolt comprising a body portion fixed to one edge portion of a door having a bolt operable on an axis across said edge portion at right angles thereto, said body portion having a guideway across the axis of the bolt at right angles thereto adjacent to the end face of the bolt when the bolt is in the retracted position, a bolt blocking plate movably engaged in said guideway and shiftable therein across the axis of the bolt between bolt blocking and bolt release positions, means engaged between the body portion and the blocking plate to yieldingly bias said blocking plate to the bolt blocking position, and an operator for the blocking plate on one face of the door including a movable actuator leaf for the blocking plate, hinge means hingedly connecting said movable actuator leaf to one vertical face of the door at right angles to said door edge portion, said movable actuator leaf engaging the blocking plate on the end away from the biasing means and being in opposed relationship to a door jamb stop surface, whereby closing of the door carrying the bolt immobilizing device automatically shifts the bolt blocking plate to the bolt release position against the force of the biasing means.

12. An immobilizing device for a door bolt as defined in claim 11, in which said movable actuator leaf has a free end adjacent said door edge portion, and said blocking plate engaging said movable actuator leaf between said free end and said hinge means.

13. An immobilizing device for a door bolt as defined in claim 11, in which said hinge means is positioned on the side of the blocking plate away from the door edge portion.

* * * * *